United States Patent [19]

Wallace et al.

[11] Patent Number: 4,742,971

[45] Date of Patent: May 10, 1988

[54] ATTACHMENT WINCH FOR VEHICLE WHEELS

[75] Inventors: John W. Wallace; Robert B. Wallace, both of Corpus Christi, Tex.

[73] Assignee: Hub Winch, Inc., Corpus Christi, Tex.

[21] Appl. No.: 933,645

[22] Filed: Nov. 24, 1986

[51] Int. Cl.[4] ..... B66D 3/00

[52] U.S. Cl. ..... 242/95; 242/77.3; 242/77.4

[58] Field of Search ..... 242/95, 77, 77.3, 77.4, 242/115, 116, 118, 118.4, 118.6, 118.7, 118.8, 77.2; 254/323; 180/7.5, 53.61

[56] References Cited

U.S. PATENT DOCUMENTS

| | | | |
|---|---|---|---|
| 1,162,822 | 12/1915 | Thomson | 242/95 |
| 1,164,747 | 12/1915 | Pillsbury | 242/95 |
| 2,507,903 | 5/1950 | Grounds | 242/95 |
| 3,160,364 | 12/1964 | Bailey | 242/95 |
| 3,368,774 | 2/1968 | Nettles | 242/118.7 |
| 3,784,163 | 1/1974 | Swanson et al. | 242/95 X |
| 3,784,164 | 1/1974 | Blum | 242/95 |
| 3,820,734 | 6/1974 | Selliken | 242/95 |
| 3,917,228 | 11/1975 | Blum | 242/95 |

FOREIGN PATENT DOCUMENTS 990884 5/1965 United Kingdom .

*Primary Examiner*—David Werner
*Attorney, Agent, or Firm*—Fulbright & Jaworski

[57] ABSTRACT

A plurality of attachable brackets having an elongate body and first and second ends perpendicular to the body. The first ends have a first opening sized to fit over a plurality of lug sizes and secured to the lug by a lug nut. The second ends have a second opening. A plate has a plurality of holes positioned radially and circumferentially for alignment with lugs of various vehicles having lugs of differing radial and circumferential positions. A plurality of nuts and bolts secure the second ends to the plate. A circular support core may be inserted between the inside of the brackets for strength and a line guide ring may be attached to the vehicle for aligning a line connected to the brackets perpendicular to the brackets.

4 Claims, 3 Drawing Sheets

ATTACHMENT WINCH FOR VEHICLE WHEELS

BACKGROUND OF THE INVENTION

Various winches for attachment to a vehicle wheel have been proposed as shown in U.S. Pat. Nos. 3,784,164; 3,820,734; and 3,917,228. With a winch attached to each of the two power wheels, lines are attached to the winches and a stationary object (tree, post or other vehicle) and the vehicle may self propel itself out of a stuck location. These devices, which utilize a threaded hole in the end of a rod for engaging the threaded wheel lugs have several major disadvantages. First, the threading of the rod is expensive in the manufacturing process. Secondly, if the threaded rod becomes bent in use, which may occur in extraditing a vehicle deeply stuck, the threaded wheel lugs could bend causing damage to the wheel and prevent the removal of the wheel without cutting off the lugs. Thirdly, these devices are limited as to the variety of vehicles on which they will fit. That is, the threaded rods will fit only a single thread whereas the size and thread count of the wheel lugs on United States and foreign automobile and trucks vary in a minimum of six configurations: left and right thread, diameters of 7/16th, ½, 9/16th and ⅝th inches, and different thread counts as well as metric versions. Furthermore, the lugs are spaced on different vehicles at various diameters and may consist of four to eight lugs which have differing radial spacing.

The present invention is directed to an attachable winch for vehicle wheels mounted on a vehicle by threaded lugs and lug nuts, which is inexpensive, and is of a configuration which reduces the possibility of the threaded lugs being bent under excessive torque applied to the winch, and can be arranged to be attachable to vehicle wheels regardless of the number of lugs, lug sizes, thread count, and radial spacing.

SUMMARY

The present invention is directed to an attachable winch for vehicle wheels mounted on the vehicle by threaded lugs and lug nuts and, includes a plurality of attachable brackets having an elongate body and first and second ends perpendicular to the body. The first ends have a first opening sized to fit over the lugs regardless of the type of thread and can be secured to the lugs by the lug nuts. The second ends of the brackets have a second opening. A plate having a plurality of holes, which are positioned radially and circumferentially for alignment with the lugs and the second openings, may be secured to the second ends of the plate by a plurality of nuts and bolts. This structure forms a winch upon which a line may be attached and secured to a stationary object thereby pulling a stuck vehicle out of mud, sand, or snow.

Still a further object of the present invention is wherein the first openings are sized to fit over a plurality of lug sizes and the plate includes a plurality of holes positioned radially and circumferentially with alignment with some of the lugs, preferably at least three, of various radially and circumferentially positioned lugs whereby the winch may be used with different vehicles having different lug patterns.

Still a further object of the present invention is the provision of a circular support core for insertion coaxially between the inside of the brackets for supporting the brackets.

Still a further object of the present invention is the provision of a guide ring attachable to the vehicle for aligning a line perpendicular to the brackets to prevent cutting of the line as the winch is rotated.

Yet a still further object of the present invention is wherein the second openings are smaller than the first openings for allowing more holes to be positioned in the plate for accommodating a greater number of lug patterns.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 4:
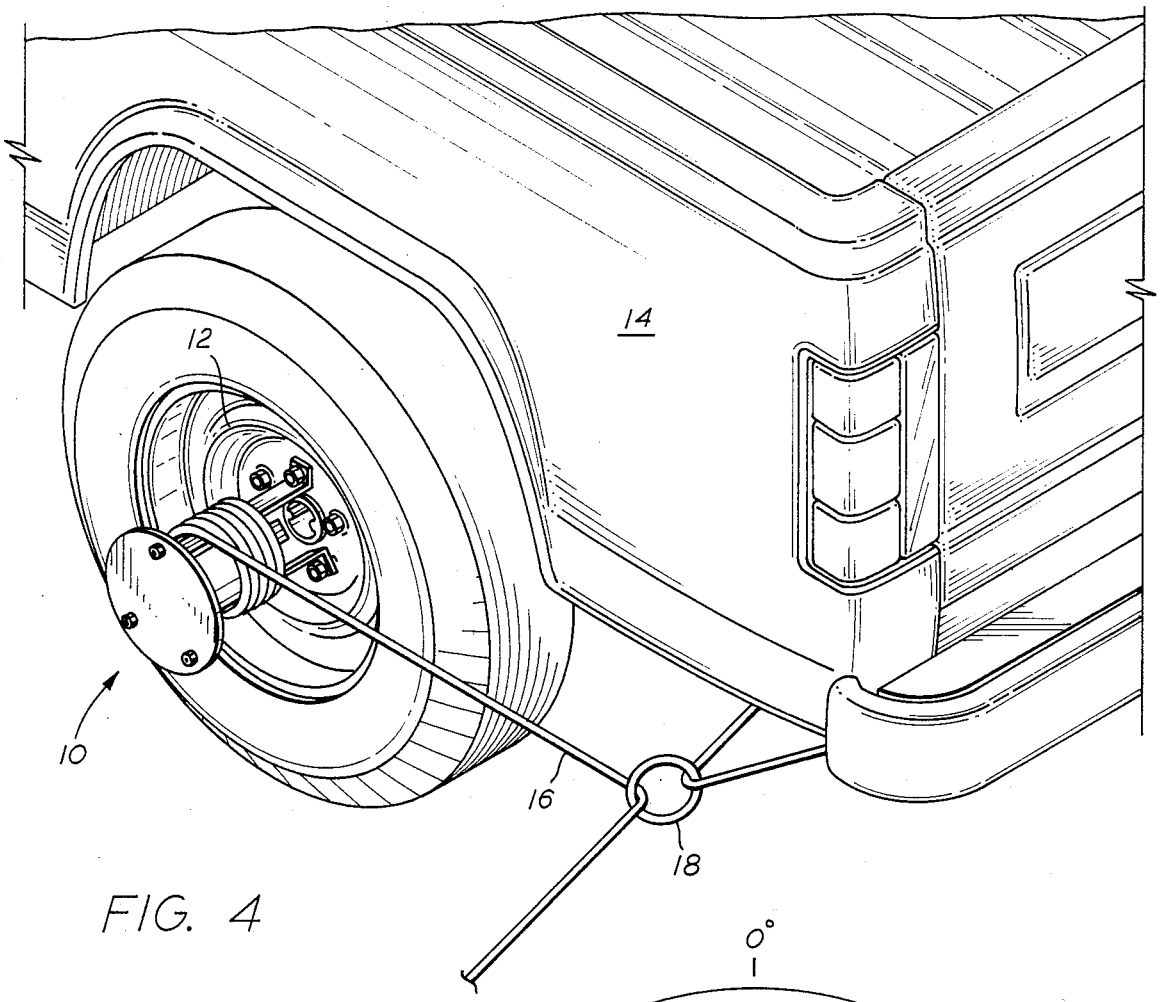
FIG. 4 is a perspective view illustrating the attachable winch connected to a vehicle wheel.

Referring now to the drawings, particularly to FIG. 4, the reference numeral 10 generally indicates the attachable winch of the present invention for connection to the wheel 12 of a vehicle 14. A winch 10 is attached to each of two power wheels 12 of the vehicle 14 and a line 16 is attached to each of the winches 10 and to another object such as a tree, post or another vehicle, preferably through a guide ring 18. As the wheel is rotated, the line will wrap around the winch 10 causing the vehicle 14 to pull itself out of a stuck position such as in mud, sand or snow.

Figure 3:
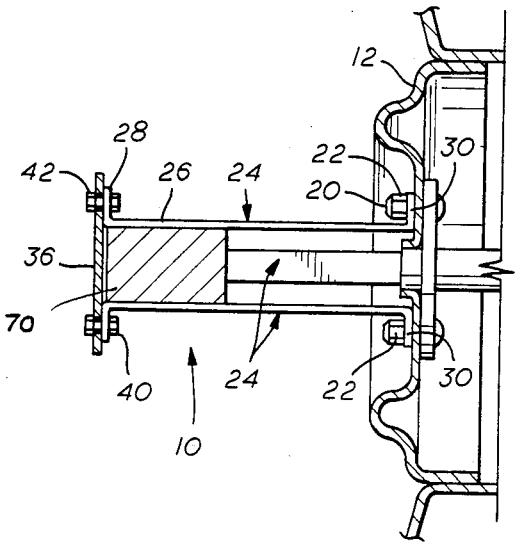
FIG. 3 is a cross-sectional view of the present invention connected to a vehicle wheel.

Referring now to FIG. 3, the wheel 12 includes a plurality of threaded lugs 20 and lug nuts 22 for mounting a tire thereon.

However, the size and position of the lugs 20 varies considerably from vehicle to vehicle. Wheels of United States and imported automobiles and light trucks have lugs on diameters of 4 inches, 4½ inches, 4¾ inches, 5 inches, 5½ inches, and 6½ inches. The number of lugs may be four, five, six or eight. In addition, the size of the lugs may be 7/16th inches, ½ inch, 9/16th inch, or ⅝th inch in diameter. Furthermore, the threads on the lugs may be left or right threads, have different thread counts as well as metric versions thereof. Therefore, it is generally impractical to provide an attachable winch threadably connected to each and every type of possible lug configuration and pattern.

Figure 1:
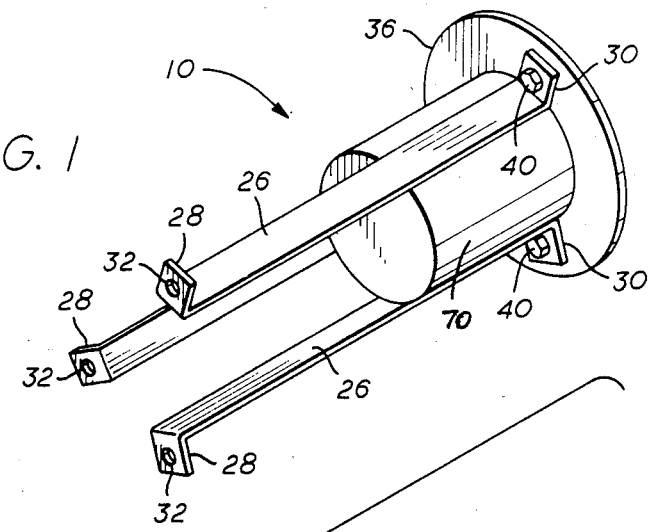
FIG. 1, is a perspective view of the attachable winch of the present invention.
Figure 2:
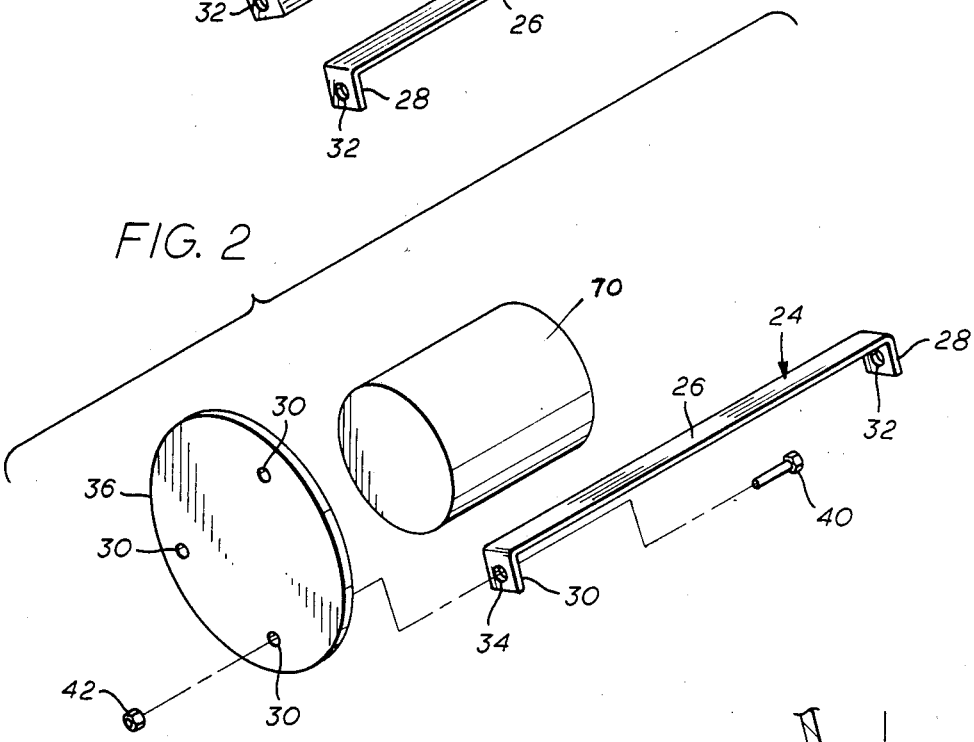
FIG. 2 is an exploded perspective view of the present invention.

Referring now to FIGS. 1–3 the winch 10 generally includes a plurality of attachable brackets 24 having an elongate body 26, a first end 28 and a second end 30.

The ends 28 and 30 are perpendicular to the body 26. The first ends 28 have a first opening 32 sized to fit over the lugs 20 and to be secured to the wheel 12 by a lug nut 22 with the aid of the vehicle lug wrench. The openings 32 are sized to fit over a plurality of sizes. Preferably, the size of the opening 32 is 11/16ths of an inch and thus are of a size to fit over the diameters of all standard size lugs. Since the first ends 28 are secured to the wheel 12 by the lug nut 22 the bracket 26 may be secured to all types of wheels irrespective of the types of threads on the lug 20. This is highly advantageous over a conventional threaded rod of prior art devices since the threaded rods are expensive to manufacture and can only be connected to a single size and thread type of lug. The present bracket 24 fits all conventional wheels because the openings 32 placed over the wheel lugs 20 are large enough to accommodate all conventional threads, whether left or right, whether metric or not, and irrespective of size. Furthermore, the brackets 24 are inexpensive to manufacture as they can be easily stamped without requiring machinery and the brackets 24 will fit all conventional cars and light trucks.

The second ends 30 of the brackets 24 each include a second opening 34. In the preferred embodiment, the openings 34 are of a size smaller than the openings 32 for reasons to be more fully discussed hereinafter.

Another important advantage of the brackets 24 over a conventional rod type winch is that sometimes, because of the great amount of force exerted upon the winch 10, the winch 10 will bend. In the case of the brackets 24, the body 26 may bend relative to the ends 28, but the lugs 20 will not be damaged. On the other hand, with a rod support threaded onto the lugs, the lugs 20 may become bent thereby damaging the wheel 12.

Referring now to FIGS. 1–3 and 7, an end plate 36 is provided having a plurality of holes 38 (only three holes are shown in FIG. 2 for purposes of illustration) positioned radially and circumferentially for alignment with the second openings 34 when the brackets 24 are secured to the lugs 20. Preferably the holes 38 are positioned radially and circumferentially for alignment with at least three lugs of most vehicles even though they have lugs of differing radial and circumferential positions. Bolts 40 and nuts 42 are provided for extending through the second openings 34 and the second end 30 of the brackets 24 to one of the holes 38 on the end plate 36. In order for the end plate 36 to accommodate the various circumferentially and radially spaced holes 38 to accommodate most vehicles, the size of the openings 34, holes 38 and bolts 40 are less than the size of the openings 32 and lugs 20. For example, a bolt 40 of ⅜th inch diameter with accommodating openings 34 and holes 38 is sufficiently small so to suitably space the holes 38 in the plate 36 without weakening the plate 36.

Figure 5:
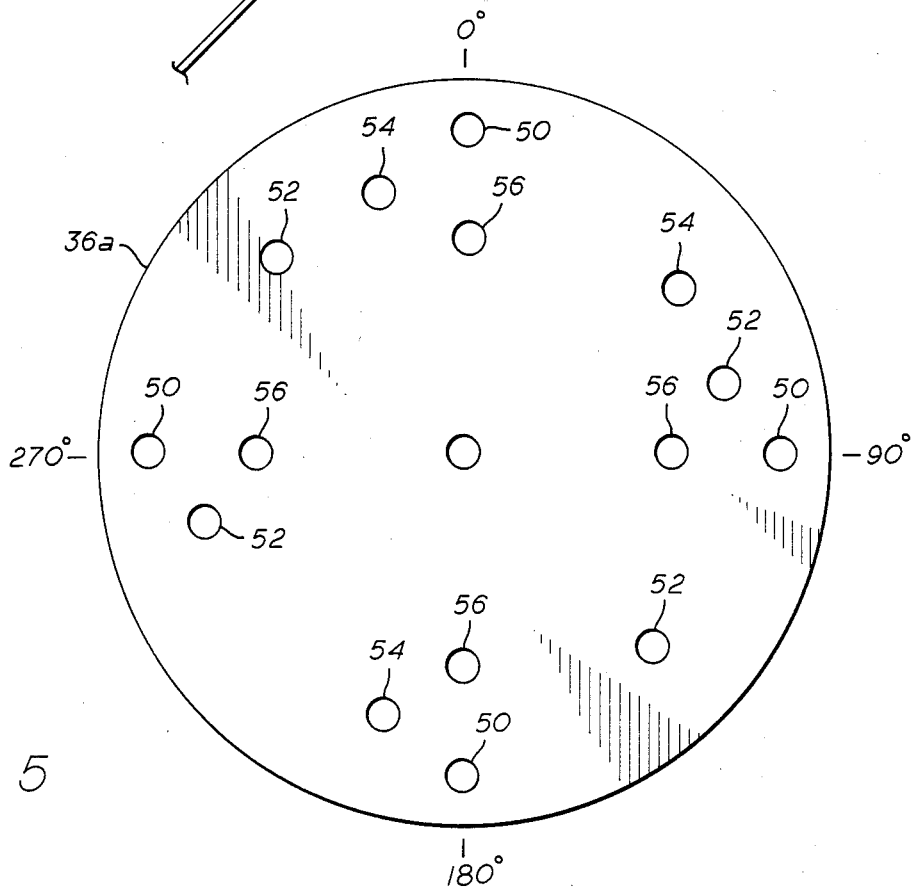
FIG. 5 is an elevational view of the spacings of the holes in an end plate for attaching the winch to most conventional trucks.

Referring now to FIG. 5, an end plate **36*a* is shown having a plurality of holes thereon spaced circumferentially and radially which will enable the plate to align with openings 34 in the brackets 24 for most conventional light trucks. Thus, holes 50 are four in number spaced a radial distance of 3.250 inches from the center of the plate 36*a* and positioned angularly at zero degrees, 90 degrees, 180 degrees and 270 degrees. Holes 50 provide places for securing four brackets 24 for use on a conventional truck having eight lugs 20 at a radial distance of 3.250 inches. Holes 52 are radially positioned a distance of 2.750 inches from the center of the plate 36*a* at angular positions of 75 degrees, 135 degrees, 255 degrees and 315 degrees and thus provide support for four brackets 24 for a six lug truck having the lugs at a radial position the same as the holes 52. Holes 54 provide three holes at a radial distance of 2.750 inches from the center of the plate 36*a* at angular positions of 53 degrees, 197 degrees, and 341 degrees for accommodating a truck having five lugs at the same radial distance. Holes 56 are four holes at a radial distance of 2.125 inches at an angular position of zero degrees, 90 degrees, 180 degrees and 270 degrees for accommodating a truck having four lugs at the same radial distance. Thus, the plate 36*a* provides holes 50, 52, 54, and 56** positioned to accommodate most trucks.

Figure 6:
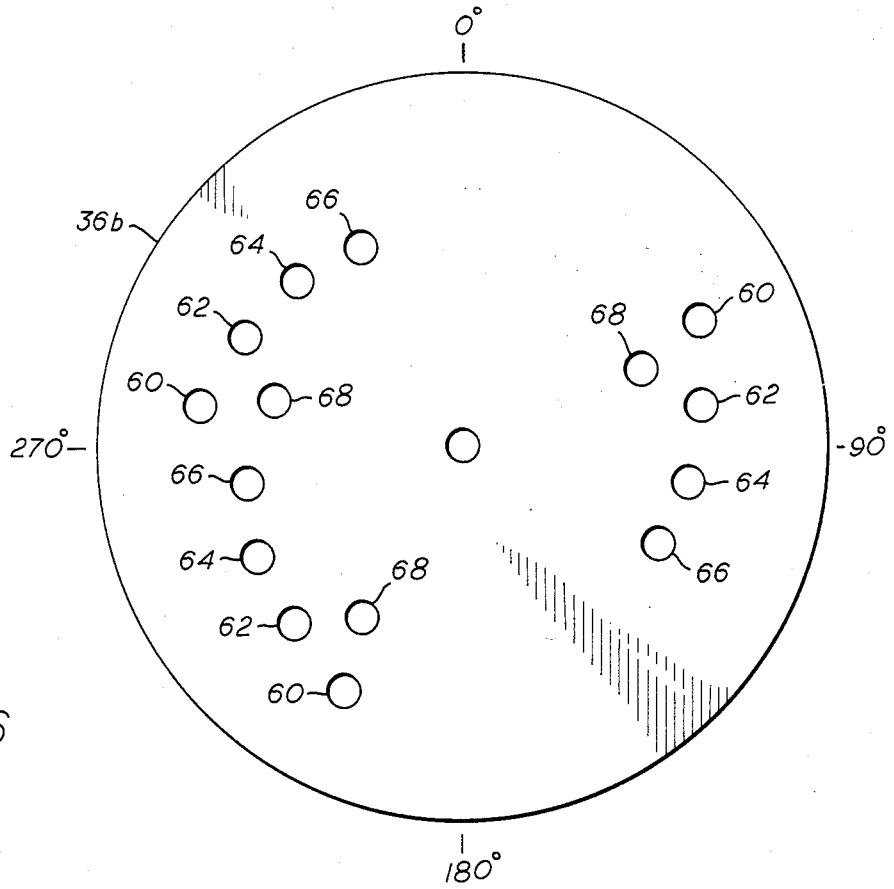
FIG. 6 is an elevational view of an end plate with the holes positioned to accommodate most conventional automobiles.
Figure 7:
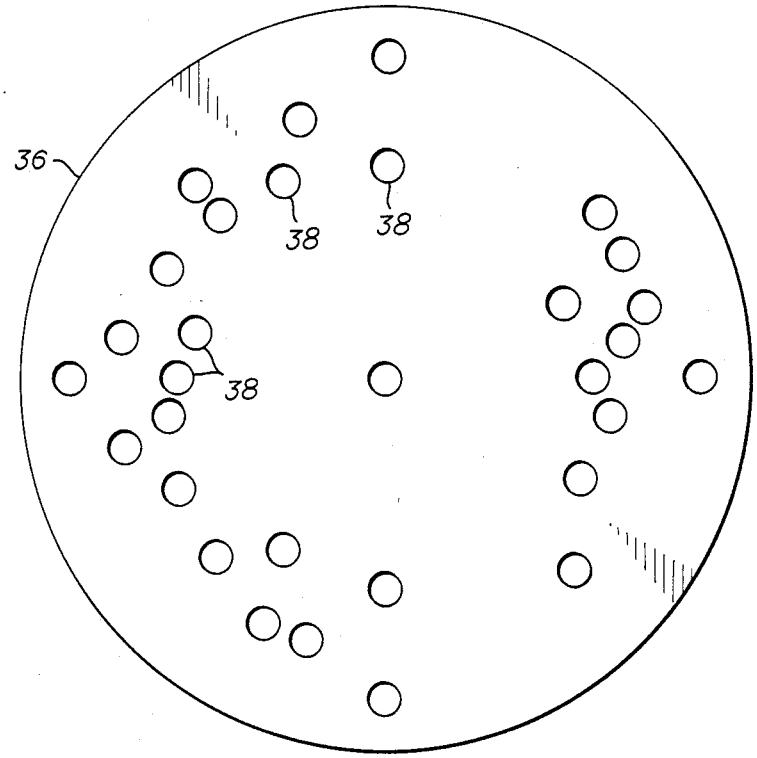
FIG. 7 is an elevational view of an end plate with holes positioned to accommodate both trucks and automobiles.

Similarly, and referring to FIG. 6, plate **36*b* is provided with holes positioned for accommodating most automobiles. Thus, three holes 60 are positioned at a radial distance of 2.750 inches from the center of plate 36*b* and at an angular position of zero degrees, 144 degrees and 216 degrees for accommodating a five lug automobile having the same radial position. Three holes 62 at a radial distance of 2.500 inches are provided at angular positions of 18 degrees, 162 degrees and 234 degrees for accommodating a five lug automobile having the same radial positions. Three holes 64 having a radial distance of 2.375 inches are angularly positioned at 36 degrees, 180 degrees and 252 degrees for accommodating a five lug automobile having the same radially positioned lugs. Holes 66 are three holes at a radial distance of 2.250 inches from the center of the plate 36*b* at angular positions of 54 degrees, 198 degrees, and 270 degrees for accommodating a five lug automobile having the same radially positioned lugs. And holes 68** are three holes at a radial position of 2.000 inches and angularly positioned at five degrees, 149 degrees, and 221 degrees for accommodating three lugs of a five lug automobile having the same radial positioned lugs.

If the plates **36*a* and 36*b* are used as separate plates, then the holes thereon may be enlarged as desired. However, the preferred embodiment has all of the holes shown in FIGS. 5 and 6 superimposed upon the plate 36 of FIG. 7 thereby limiting the size of the holes 38 thereon. It is to be noted that in superimposing the holes on the plates 36*a* and 36*b* upon the plate 36, the holes on the plates 36*a* and 36*b* must be rotated relative to each other to form a non-conflicting or non-interfering hole 38** pattern.

Referring now to FIGS. 1–3, a circular support core 70 is provided for insertion coaxially between the inside of the brackets 24 for supporting the brackets. While the core 70 may not be needed in most cases, it is helpful when the vehicle 14 is deeply stuck and creates a heavy torque on the winch 10 which can in some cases, where the bolts 40 are of a small size, cause shearing of the bolts 40. However, the insertion of the core 70 acts to support the brackets 24 and the bolts 40.

It is to be noted that the components of the winch 10 can be assembled without the need of special tools as the lug nuts 22 are tightened in place with the lug wrench of the truck and conventional automobile tools may secure the bolts 40 and nuts 42 in place.

In use, a lug nut 22 is removed from the wheel 12 and the opening 32 of a bracket 24 is placed over a lug 20 and the lug nut 22 is replaced to secure the first bracket 24 to the wheel 12. This operation is repeated for the remainder of the brackets 24, a core 70 may be inserted for additional strength, and a plate 36, **36*a* or 36*b* is secured to the second ends 30 of the brackets 24 by the bolts 40 and nuts 42**.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. An attachable winch for vehicle wheels mounted on a vehicle by threaded lugs and lug nuts comprising, a plurality of attachable brackets having an elongate body and first and second ends perpendicular to the body, said first ends having a first opening sized to fit over a plurality of lug sizes and adapted to be secured to a lug by a lug nut, said second ends having a second opening, a plate having a plurality of holes positioned radially and circumferentially for alignment with at least three lugs of various vehicles having lugs of differing radial and circumferential positions, a plurality of nuts and bolts for securing the second ends to the plate whereby the apparatus may be used with different vehicles having different lug patterns, and said holes are positioned to include four first holes spaced a radial distance of approximately 3.25 inches from the center of the plate and positioned 90 degrees apart, four second holes which are positioned a radial distance of approximately 2.75 inches from the center of the plate wherein the second holes are angularly spaced 60 degrees or multiples thereof from each other, three third holes positioned at a radial distance of approximately 2.75 inches from the center of the plate at angular distances of approximately 72 degrees or multiples thereof from each other, and four fourth holes at a radial distance of 2.125 inches from the center of the plate at an angular position of 90 degrees to each other.

2. An attachable winch for vehicle wheels mounted on a vehicle by threaded lugs and lug nuts comprising, a plurality of attachable brackets having an elongate body and first and second ends perpendicular to the body, said first ends having a first opening sized to fit over a plurality of lug sizes and adapted to be secured to a lug by a lug nut, said second ends having a second opening, a plate having a plurality of holes positioned radially and circumferentially for alignment with at least three lugs of various vehicles having lugs of differing radial and circumferential positions, a plurality of nuts and bolts for securing the second ends to the plate whereby the apparatus may be used with different vehicles having different lug patterns, and said holes are positioned to include three first holes at a radial distance of approximately 2.75 inches from the center of the plate and at an angular position of 72 degrees or multiples thereof from each other, three second holes at a radial distance of approximately 2.50 inches from the center of the plate and at angular positions of 72 degrees or multiples thereof from each other, three third holes having a radial distance of approximately 2.375 inches from the center of the plate and angularly positioned at 72 degrees or multiples thereof from each other, and three fourth holes at a radial distance of approximately 2.250 inches from the center of the plate at an angular position of 72 degrees or multiples thereof from each other, and three fifth holes positioned at a radial position of 2.00 inches from the center of the plate and positioned at 72 degrees or multiples thereof from each other.

3. An attachable winch kit for vehicle wheels mounted on a vehicle by threaded lugs and lug nuts comprising, a plurality of separate attachable brackets having an elongate body and first and second ends perpendicular to the body, said first ends having a first opening sized to fit over a plurality of lug sizes and adapted to be secured to a lug by a lug nut whereby said first ends may be secured to lugs of various vehicles having lugs of differing radial and circumferential positions, said second ends having a second opening, a plate having at least first and second sets of a plurality of holes positioned radially and circumferentially for alignment with at least three lugs of various vehicles, said first and second sets of plurality of holes having differing radial and circumferential positions for alignment with at least three lugs of various vehicles having lugs of differing radial and circumferential positions, and a plurality of nuts and bolts for securing the second ends to the plate whereby the attachable winch may be used with different vehicles having different lug patterns.

4. The apparatus of claim 3 wherein the second openings are smaller than the first openings for allowing more holes to be positioned on the plate.

* * * * *